US012644662B2

(12) United States Patent
Kheraj et al.

(10) Patent No.: US 12,644,662 B2
(45) Date of Patent: Jun. 2, 2026

(54) ELECTRIC FIREARM

(71) Applicants: Reshma N Kheraj, Dunwoody, GA (US); Naresh Pulipati, Dunwoody, GA (US)

(72) Inventors: Reshma N Kheraj, Dunwoody, GA (US); Naresh Pulipati, Dunwoody, GA (US)

(73) Assignee: Astra IP Holdings LLC, Oxford, GA (US)

( * ) Notice: Subject to any disclaimer, the term of this patent is extended or adjusted under 35 U.S.C. 154(b) by 0 days.

(21) Appl. No.: 18/914,633

(22) Filed: Oct. 14, 2024

(65) Prior Publication Data

US 2025/0297824 A1 Sep. 25, 2025

Related U.S. Application Data

(60) Provisional application No. 63/567,914, filed on Mar. 20, 2024.

(51) Int. Cl.
*F41A 19/59* (2006.01)

(52) U.S. Cl.
CPC ..... *F41A 19/59* (2013.01)

(58) Field of Classification Search
CPC ..... F41A 19/58–67; F41A 19/69–70
USPC ..... 42/84
See application file for complete search history.

(56) References Cited

U.S. PATENT DOCUMENTS

| | | | | |
|---|---|---|---|---|
| 4,009,536 | A * | 3/1977 | Wolff | F41A 19/59 89/135 |
| 4,134,223 | A * | 1/1979 | Hillenbrandt | F41A 19/59 42/84 |
| 11,047,634 | B2 * | 6/2021 | Grier | F41A 9/65 |
| 11,326,847 | B1 * | 5/2022 | Bango | F41A 17/063 |
| 2021/0222985 | A1 * | 7/2021 | Wiseman | F41A 31/00 |

FOREIGN PATENT DOCUMENTS

| | | | | |
|---|---|---|---|---|
| CN | 210400158 | U * | 4/2020 | |
| DE | 102016004678 | A1 * | 10/2017 | F41A 3/54 |
| DE | 202019000272 | U1 * | 3/2019 | F41A 19/59 |
| DE | 102018005127 | A1 * | 1/2020 | F41A 3/66 |
| JP | 2019000272 | A * | 1/2019 | |

* cited by examiner

*Primary Examiner* — John Cooper
(74) *Attorney, Agent, or Firm* — Patent 360; Barry Choobin

(57) ABSTRACT

A firearm includes a fixed magnet and a movable magnet, wherein at least one of the fixed magnet and the movable magnet is an electromagnet. A control unit can charge the electromagnet causing the movable magnet to move towards the fixed magnet with high speed under electromagnetic forces. A firing pin is coupled with a movable magnet. The movable magnet moving at high speed causes the firing pin to strike a bullet loaded in the firearm resulting in the firing of the bullet.

12 Claims, 4 Drawing Sheets

ELECTRIC FIREARM

CROSS-REFERENCE TO RELATED APPLICATIONS

This application claims priority from a U.S. Provisional Patent Appl. No. 63/567,914, filed on Mar. 20, 2024, which is incorporated herein by reference in its entirety.

FIELD OF INVENTION

The present invention relates to a firearm, and more particularly, the present invention relates to an electric firearm with an electromagnetic firing mechanism.

BACKGROUND

The firing mechanism in a firearm plays a crucial role in its performance and efficiency. Typically, a firing mechanism involves activating a trigger, which releases a firing pin. The pin moves at a high velocity and strikes a primer on a bullet, causing it to explode. The spark generated by this collision ignites the gunpowder in the bullet, resulting in the firing of the bullet from the firearm.

Firearms can be broadly classified into three categories based on their firing mechanism and the process of loading new bullets: manual, automatic, and semi-automatic. Considerable research has been conducted to enhance firing mechanisms, and there is an industrial need to explore new firing mechanisms.

It is to be noted that the firearm described herein can be electronic, electric, or electromagnetic, and said terms are interchangeably used.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an electromagnetic firing mechanism for firearms.

Another object of the present invention is that the firearm can be operated more easily and comfortably.

Still, another object of the present invention is that the firing rate can be electronically controlled.

Yet another object of the present invention is that a high firing rate can be easily achieved.

In one aspect, disclosed is a firearm comprising a fixed magnet positioned behind a chamber of the firearm; a movable magnet configured to move in a back-and-forth motion within a channel in the firearm, wherein at least one of the fixed magnet and the movable magnet is an electromagnet; a firing pin coupled to a first face of the movable magnet, the first face facing the fixed magnet; a control unit coupled to the electromagnet, wherein the control unit is configured to charge the electromagnet based on predefined rules, wherein the movable magnet is configured to move towards the fixed magnet under electromagnetic forces which results in the firing pin to strike a primer on the bullet, and the bullet firing through the chamber; and a trigger operably coupled to the control unit.

In one aspect, the fixed magnet is the electromagnet, and the movable magnet is a permanent magnet. The fixed magnet and the movable magnet are electromagnets. The firearm further comprises cushioning members coupled at the ends of the channel to prevent damage to the movable magnet. The firearm further comprises a switch configured to turn the firearm on and off. The switch is in the form of a slider. The firearm further comprises a GPS circuitry configured for geofencing around the firearm. The firearm further comprises a camera. The firearm further comprises a battery configured to be slidably received within a handle of the firearm.

In one aspect, the firearm further comprises a second fixed magnet, wherein the fixed magnet and the second fixed magnet are electromagnets, wherein the two fixed magnets are configured to move the movable magnet in the back-and-forth motion. A second firing pin is coupled to the movable magnet opposite to the firing pin.

BRIEF DESCRIPTION OF DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
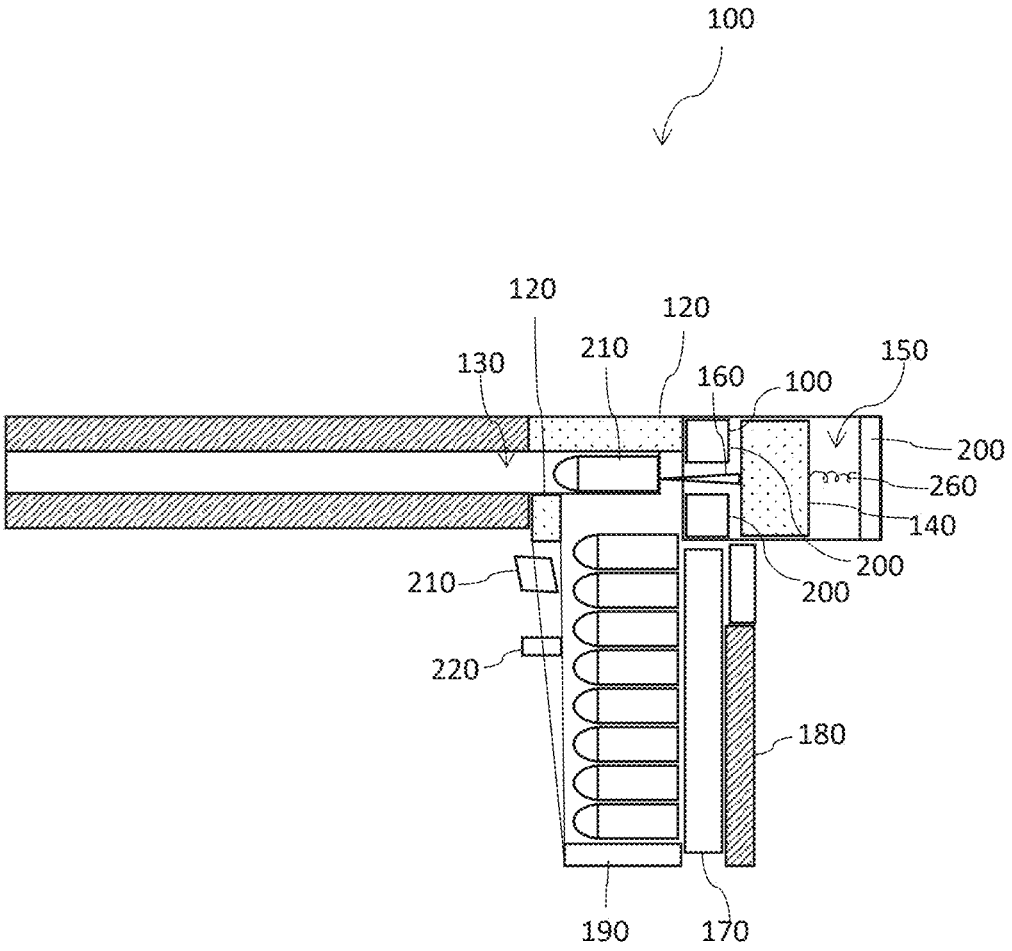
FIG. 1 shows a gun to illustrate the different components, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is to describe particular embodiments only and is not intended to be limiting to embodiments of the invention. As used herein, the singular forms "a", "an" and "the" are intended to include the plural forms as well, unless the context clearly indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

The described invention pertains to an electronic firearm with an electromagnetic firing mechanism. The electromagnetic firing mechanism uses a movable magnet and a fixed magnet. The magnet can be an electromagnet or a permanent magnet, provided that at least one magnet is an electromagnet. Alternative magnetic poles between the two magnets cause the movable magnet to move in a to & fro motion relative to the fixed magnet. The movable magnet is moved to an extremely high speed by electromagnetic forces. The movable magnet has a firing pin and the firing pin moving at an extremely high speed can explode the primer on the bullet efficiently and with great force. A higher frequency of changing the poles of the electromagnet can be easily achieved, therefore, the firing rate can be precisely controlled for different firing rates.

Figure 2:
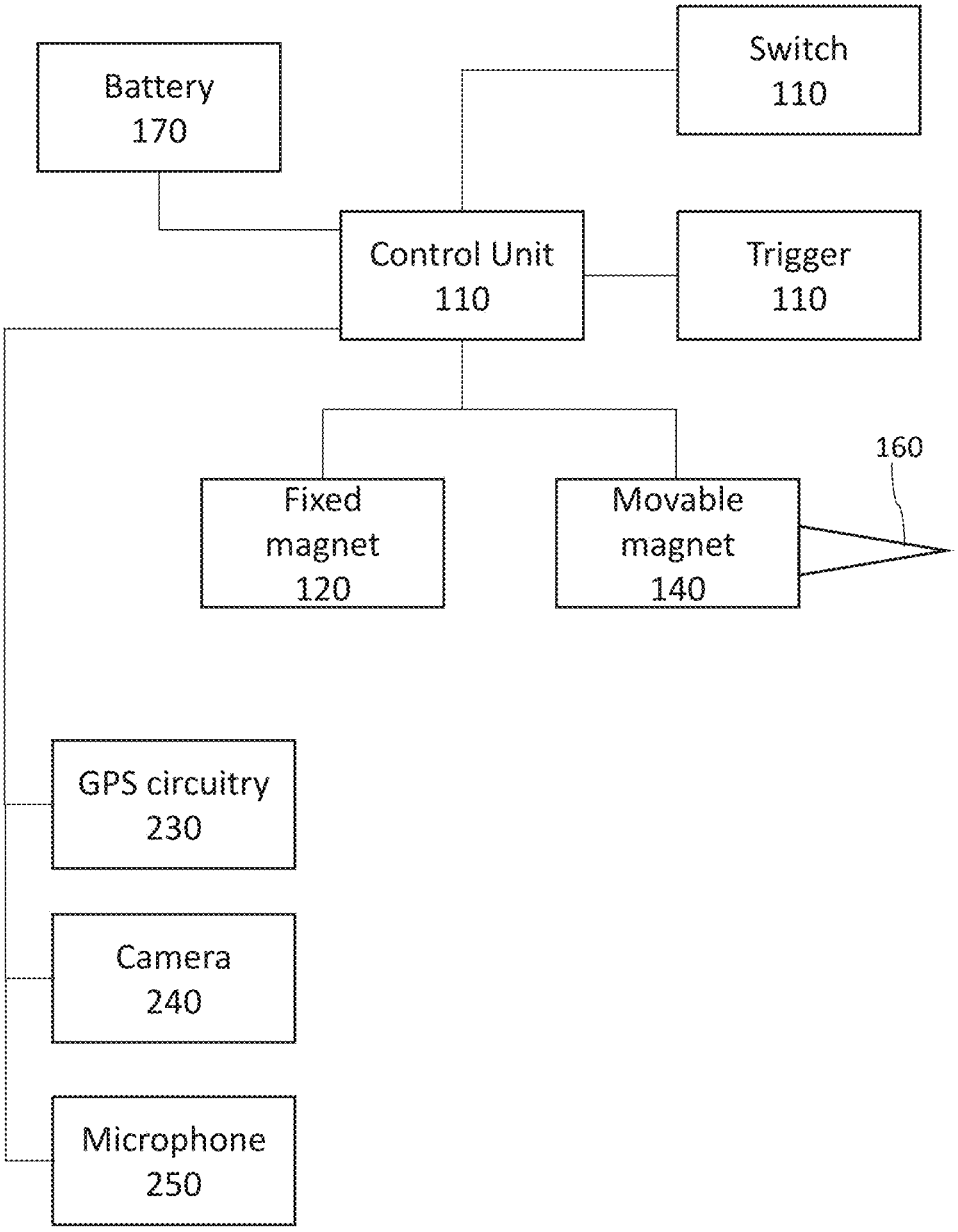
FIG. 2 is a block diagram showing the firing mechanism, according to an exemplary embodiment of the present invention.

Referring to FIG. 1 which shows a sectional view of a firearm 100 for firing bullets and FIG. 2 which is a block diagram illustrating the firing mechanism, according to an embodiment of the present invention. Firearm 100 includes a control unit 110 that can control the charging of the electromagnet. Firearm 100 includes a fixed magnet 120 that remains fixed i.e., does not move. The fixed magnet 120 can be configured behind chamber 130 of the firearm 100. The fixed magnet can be coupled to the control unit. Preferably, the fixed magnet can be an electromagnet controlled by the control unit. The polarity of the fixed electromagnet can be controlled by the control unit for moving the movable magnet. FIG. 1 further shows the movable magnet 140 within a channel 150 of the firearm. The movable magnet 140 has a firing pin 160 on its front side facing the chamber of the firearm. The movable magnet can be an electromagnet or a permanent magnet. Also, the movable magnet may be connected to the control unit. The movable magnet can move back and forth within the channel under magnetic forces.

The apparatus further includes a battery 170 for powering the control unit and the electromagnets. The control unit can control the flow of current including the direction of current to the electromagnets. As shown in FIG. 1, the battery can have an elongated profile that can be encased within a handle 180 of the firearm or can act as a part of the handle. For example, magazine 190 and the battery 170 can form the handle 180 of the firearm 100. The battery can be removable from the firearm. Also, the battery may be rechargeable, however, any type of battery is within the scope of the present invention. Also, the battery may include multiple battery units or cells.

The electromagnets can be insulated to prevent any electrical shock or short circuit. The insulation can be durable for withstanding the collisions of the movable magnet. Also, the insulation may withstand the explosion and burning of the gunpowder. Also, suitable cushioning members 200 can be configured at one or both ends of the channel to which the movable magnet may collide. The cushioning members may prevent damage to the movable magnet from the shock of collision. The cushioning members can absorb any collision forces protecting the contact surface of the two magnets.

The apparatus may also include a suitable loading mechanism for guns. For example, FIG. 1 shows a magazine 190 that can be loaded with bullets 210. It is to be understood that the invention is described for use with bullets having gun powder, however, the aspects of the invention can also be applied to other types of bullets, such as rubber bullets, training bullets, blanks, BBs, and pellets. For example, the firing pin can be replaced by a striker or similar firing mechanism that can transfer the force to the bullet. Thus, bullets, cartridges, pellets, and the like projectiles are within the scope of the present invention. The loading mechanism can be a projectile loading mechanism and can be adapted for different kinds of projectiles.

The apparatus may also include a trigger 220 to instruct the control unit 110 to fire the bullet. The trigger can be similar to a conventional trigger i.e., located near a handle to be actuated by a finger while holding the firearm in hand. Unlike a conventional mechanical trigger, the trigger of the claimed invention is an electronic button that can be pressed without any undue force. Thus, the shape and position of the trigger can vary easily, and such variations are within the scope of the present invention. Moreover, the trigger can be operated remotely and wirelessly. For example, wireless signal-receiving circuitry can be incorporated into the apparatus, maybe in the control unit itself. The wireless signal-receiving circuitry can receive a signal from a remote controller. The remote controller can have the trigger button either in hard form or soft form. Singal can be sent on wireless networks, such as Bluetooth®, Wi-Fi, Internet, and the like. Thus, the firearm can be connected to a remote computing device or any electronic device through a suitable network.

This firearm may also include a safety lock 220 to prevent accidental firing from the firearm. The safety lock can engage and disengage a circuit, for example, the power supply, or the triggering mechanism from the trigger. The safety lock can be built into the control unit and operated by a button provided on the firearm. Such a button can be in the form of a slider that cannot be accidentally pressed. Like the trigger, the safety lock can also be operated remotely and wirelessly. In certain implementations, features of passcode or biometric authentication for operating the firearm can also be incorporated. For example, the safety lock can be opened only after entering a passcode through a smartphone device.

The electronic firearm of the present invention may also support features, such as geofencing. Features of geo-tagging capabilities to track the location of the firearm can also be incorporated. The Firearm can be equipped with suitable GPS circuitry 230. The means for biometric authentication can also be implemented on the firearm itself. For example, a fingerprint sensor can be used to authenticate a user and to unlock the firearm only upon successful authentication.

The firearm may also include a biasing mechanism 260 for the movable magnet. The biasing mechanism may prevent the free movement of the movable magnet within the channel in the absence of any electromagnetic forces. In the absence of electromagnetic forces, the movable magnet can be positioned on an end of the channel away from the fixed magnet. Thus, the biasing mechanism can maintain separation and distance between the fixed and movable magnets during idle state. The biasing mechanism may use a spring or a similar elastic member. The elastic member can be preferably insulated or made from an insulating material.

In certain implementations, the power source can be a battery. However, any other power source is within the scope of the present invention. The power source can be removable from the firearm. Moreover, the power source can be a part of the firearm or separate from the firearm. Also, the power source can be completely disengaged for safety. For example, firearms can be stored without a power source.

In certain implementations, the firearm may also include a camera 240 and/or a microphone 250. The camera can be used to record, in general, the objective of the firearm and firing from the firearm. The camera can also be used for aiming at the target. For example, the firearm can be used remotely, wherein the target can be set using the camera. This may help in combat operations, public safety, surveillance, gaming, and the like.

It is to be noted that FIG. 1 shows an exemplary illustration of the firearm, the architecture, functionality, and type of firearm can be varied, and any such firearm with the disclosed firing mechanism is within the scope of the present invention. Also, the principles of oscillating movement of a magnet caused by electromagnetic forces can be applied to any other device, apparatus, machine, tool, and the like.

In use, the firearm can be turned on by attaching the power source and unlocking any safety lock. Suitable indicators such as LED indicators or beep sounds can check the status of the firearm. In an idle state, the movable magnet can be positioned away from the fixed magnet. Upon pressing the trigger, the control unit can energize the electromagnets, so that the movable magnet and the fixed magnet are magnetically attracted toward each other. The movable magnet moves with force and the firing pin hits the bullet, causing the bullet to get fired and propelled through the barrel. Once the bullet is fired, immediately the control unit reverses the current flow & magnetic pole orientation causing the movable magnet to be repelled by the fixed magnet. The movable magnet is restored to its resting position. The control unit can detect a firing pin hit by any suitable mechanism, such as timing circuitry, sensors, and the like. As soon as the bullet is fired, the empty shell of the bullet ejects out of the gun and the spring-loaded magazine loads another bullet in the compartment ready to be fired. As the trigger is pressed, the control unit charges the electromagnets to initiate the firing sequence.

In certain implementations, the control unit allows for continuous firing at the preferred firing rate. The firing rate can be manipulated as and when desired. For example, the trigger can be kept actuated i.e., not released, triggering the continuous firing from the firearm. The control unit can cause the firing sequence to repeat at the predefined frequency until the trigger is released.

In certain implementations, the movable magnet can be manually controlled. For example, a button can be provided which upon actuation charges the electromagnet in opposite polarity. The button can be pressed again to charge the electromagnets to change the poles.

The control unit can manipulate the firing range, speed & force of the firing pin by increasing or decreasing the electric current intensity of electromagnets thus varying the magnetic strength of the electromagnets.

Figure 3:
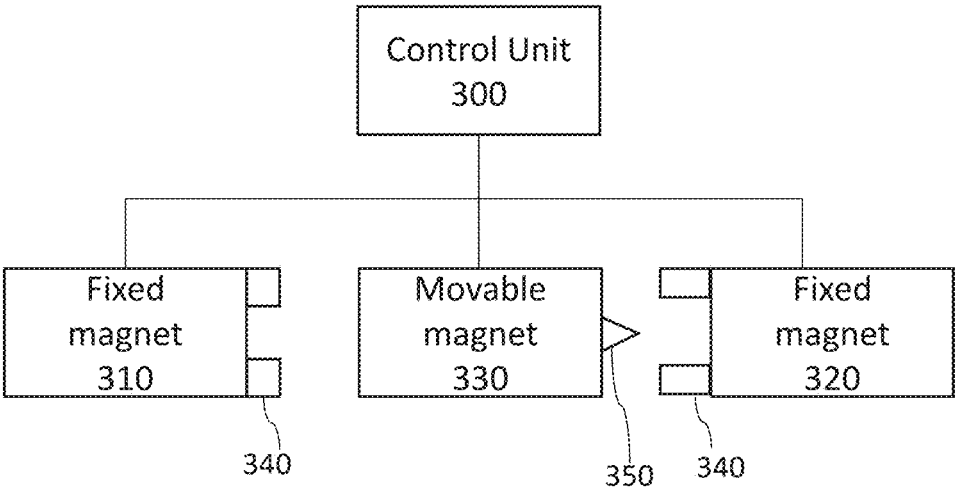
FIG. 3 shows the firing mechanism having two fixed magnets, according to an exemplary embodiment of the present invention.

In certain implementations, two fixed electromagnets can be used to control the motion of a movable magnet, as shown in FIG. 3. The movable magnet 330, which includes a firing pin 350, can be an electromagnet or a permanent magnet. The control unit 300 can charge the first electromagnet 310 causing the movable magnet to move towards the first electromagnet 310. By the time, the movable magnet 330 reaches close to the first electromagnet 310, the control unit 300 can turn off the first electromagnet 310 and charge the second electromagnet 320. The movable magnet 330 is now attracted by the second electromagnet 320 and so reverses the direction and moves towards the second electromagnet 320. This cycle can be repeated at a desired frequency. The frequency can be changed by changing the time, charging intensity of the electromagnets, and like factors. Based on the set frequency, the control unit 300 can oscillate the movable magnet 330 between the two fixed electromagnets. The firing pin 350 can be attached to movable magnet. Proper insulation can be used to prevent any short circuits and damage to the magnets. Spacers 340 can be used for cushioning of the movable magnets.

Figure 4:
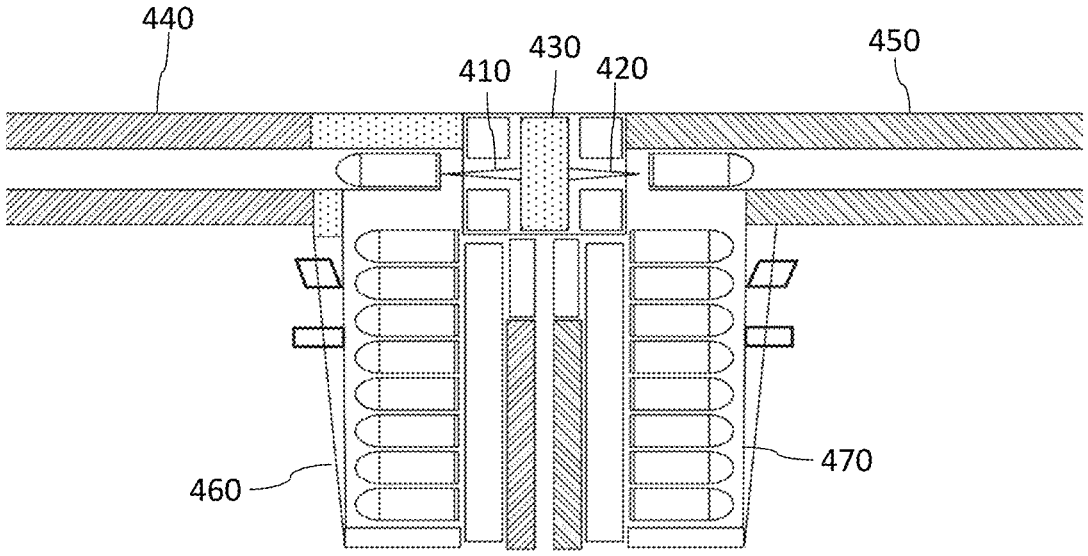
FIG. 4 shows the firearm having a second barrel and firing pin, according to an exemplary embodiment of the present invention.

In certain implementations, a first firing pin 410 and a second firing pin 420 can be attached to opposite sides of the movable magnet 430 allowing firing the bullets from both sides. The firearm can have two or more barrels in opposite directions and two bullet-loading magazines. FIG. 4 shows two barrels 440 and 450 and two loading magazines 460 and 470. The firearm can also be rotated when firing from two opposite-facing barrels. In certain implementations, the two or more barrels may face the same side. In such a case, a mechanism to transfer force from the firing pin to the bullet in the reverse direction can be provided. For example, the firing pin can hit a lever which pivots to hit the bullet.

The firearm may also include a laser for setting the target or aiming at the target. Features of artificial intelligence can also be used to ensure the safe use of the firearm and aim at the target. Inputs from lasers and optical sensors can be used to aim at the target using artificial intelligence. An AI model can be trained using information about projectiles and the effect of environmental conditions on the projectiles. Hit and trial in shooting a target with the firearm can also be used to train the AI model. The firearm can detect motion to enhance self-decision-making capabilities using AI technologies or any other compatible methods/technologies.

Examples of firearms include pistols, revolvers, derringers; rifles, shotguns, submachine guns, machine guns, BB guns/rifles, air guns/rifles, utility guns like nail guns, staple guns, or anything with a barrel, etc. The firearm can be installed on all types of manned/unmanned/self-driving/self-flying/self-propelling vehicles in the air, on land & water like military tanks, ground vehicles, trains, fighter jets, helicopters, choppers, naval ships, drones, RC based Bots & vehicles, submarines, Government, private & public sector vehicles, etc. This device can also be used for domestic public safety & armed surveillance for all sectors.

The control unit of this device can also be programmed to make self-decisions using technologies like Artificial Intelligence (AI) technologies or any other computer programs or any other compatible technologies to trigger the firing mechanism.

This device can be installed or can be an integral part of the robots where a firearm can be triggered using a remote command center or the robot can make decisions based on Artificial Intelligence (AI) technologies or any other computer-based programs or any other compatible technologies. Especially useful in unmanned combat operations, these devices can be used for surveillance and securing borders without any manual intervention. The overall principle of this device can be used for Autonomous Armed Surveillance (AAS) or autonomous weapons that can installed or deployed or can be an integral part of all compatible vehicles, devices, mechanisms, components, buildings, vehicles, etc. The firing mechanism is also referred to herein as a device, and the apparatus includes the device. Different kinds of apparatuses can include the disclosed device. Also, disclosed is an apparatus including the disclosed device. This device can also be operated at ultra-high speed compared to any currently available firearm weapon or device. This device offers minimal blowback and stability along the axis of firing since no manual force must be applied in the actuation of the trigger. The trigger does not need to be pressed manually for firing and can be controlled by the control unit automatically, making it a unique weapon/device than any out there in the market.

In certain implementations, the electro-mechanical components in combination with magnetic or non-magnetic components can be used to trigger the firing mechanism or generate all possible motion ("to & fro" or "pulsating" or "vibratory" or "Oscillatory" etc. motion/energy/power) that can be operated manually or remotely using all compatible technologies, methods, principles, software, etc.

The magnets/electromagnets are physically connected to a control unit (though an electrical wire or any other means) where the control unit connected to the power source manages charging the electromagnets and reversing poles of the electromagnets using electric current.

Grooved rail guidance mechanism, ball bearings (non-magnetic), nonmagnetic balls, fluid-based guidance, or any other means/mechanism can be used to position the electromagnet as it moves with the channel. Also, the movable magnet can be easily removed and replaced as desired. Non-movable electromagnet/magnet can be an integral part of the firearm, and it can be removed and replaced as desired.

In certain implementations, a solenoid can also be used as a firing mechanism in a gun. The firing pin can be attached to a plunger/piston of the solenoid, wherein the control unit can power the solenoid. The solenoid can be a type of electromagnet formed by a helical coil of wire which upon charging can generate a controlled magnetic field that moves a plunger in a back-and-forth motion. The control unit can turn on/off the solenoid, when the solenoid is in an on position, the plunger of the solenoid moves forward with force to trigger the firing of the firearm, once the solenoid is in an off position, the plunger moves back to its original position. The control unit can manipulate current intensity and on/off the solenoid to control the speed of firing and force of the firing of the firearm. The control unit can also manipulate the on/off cycles of the solenoid, so that high/low-speed triggering of a firearm can be achieved, for example, the control unit can turn on/off the solenoid many times within a time frame to trigger firing. The push-pull plunger can also be manipulated to trigger firing in multiple directions & dimensions In another implementation, electro-mechanical components in combination with magnetic or without magnetic components can be used to trigger firing mechanism or generate all motion ("to & fro" or "pulsating" or "vibratory" or "Oscillatory" etc. motion/energy/power) that can be operated manually or remotely using all compatible technologies, methods, principles, software etc. For example, an electric motor can be used to produce "to & fro" or "pulsating" or "vibratory motion" in combination with a pin, lever etc., which can be used to fire the bullet. The power to the motor and motor speed can be controlled by a control unit.

In certain implementations, the system may include a remote-control unit that can be used to operate multiple firearms according to the present invention. For example, one hundred firearms can be fired with a single trigger. The firearm can be locked, deactivated, or disengaged remotely from the control unit or a user device, such as a smartphone, for safety. The user can also lock the firearm if it gets stolen, misplaced, or in possession of an unauthorized person. In certain cases, the firearm can also be activated manually with a manual override option. The firearm can also be equipped with a high-energy weaponized laser that works with the same control unit and power source.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A firearm comprising:

a first fixed magnet positioned behind a chamber of the firearm, the first fixed magnet is an electromagnet;

a movable magnet configured to move in a back-and-forth motion within a channel in the firearm;

a firing pin coupled to a first face of the movable magnet;

a second fixed magnet coupled opposite to the first fixed magnet and the movable magnet is configured to move between the first and second fixed magnets, the second fixed magnet is an electromagnet;

a control unit coupled to the first and second fixed magnets, wherein the control unit is configured to charge the first and second fixed magnets based on predefined rules, wherein the movable magnet is configured to move towards the first and second fixed magnets under electromagnetic forces which results in the firing pin to strike a primer on a bullet, and the bullet firing through the chamber, the control unit is configured to charge the first and second fixed magnets alternatively causing back and forth motion of the moving magnet; and a trigger operably coupled to the control unit.

2. The firearm according to claim 1, wherein the firearm further comprises:

cushioning members coupled at ends of the channel for preventing damage to the movable magnet.

3. The firearm according to claim 2, wherein the firearm further comprises:

a switch configured to turn the firearm on and off.

4. The firearm according to claim 3, wherein the switch is in a form of a slider.

5. The firearm according to claim 1, wherein the firearm further comprises:

a GPS circuitry configured for geofencing around the firearm.

6. The firearm according to claim 1, wherein the firearm further comprises:

a camera.

7. The firearm according to claim 1, wherein the firearm further comprises:

a battery configured to be slidably received within a handle of the firearm.

8. A firearm comprising:

a first barrel a second barrel, a movable magnet configured to move in a back-and-forth motion within a channel in the firearm, a fixed magnet positioned at an end of the channel, wherein at least the movable magnet or the fixed magnet is an electromagnet;

a first firing pin coupled to a front face of the movable magnet and a second firing pin coupled to a rear face of the movable magnet, wherein the second firing pin points opposite to the first firing pin;

a control unit coupled to the electromagnet, wherein the control unit is configured to charge the electromagnet based on predefined rules, wherein the movable magnet is configured to move back and forth relative to the fixed magnet under electromagnetic forces which results in the first firing pin to strike a primer on the first bullet and the second firing pin to strike a primer on the second bullet consecutively, and the first bullet firing through the first barrel and the second bullet firing through the second barrel; and a trigger operably coupled to the control unit.

9. The firearm according to claim 8, wherein the first barrel and the second barrel point in opposite direction.

10. The firearm according to claim 9, wherein the first barrel and the second barrel are aligned along a common axis.

11. The firearm according to claim 9, wherein the first barrel and the second barrel are configured to be rotated while bullets are fired from the firearm.

12. The firearm according to claim 8, wherein the first barrel and the second barrel points in same direction, the firearm further comprises a lever, wherein the second firing pin is configured to hit an end of the lever which pivots to hit the second bullet causing the second bullet to fire from the second barrel.

* * * * *